US005878635A

United States Patent [19]

Hsieh

[11] Patent Number: 5,878,635

[45] Date of Patent: Mar. 9, 1999

[54] REVERSIBLE RATCHET WRENCH

[76] Inventor: Chih-Ching Hsieh, No. 64, Lane 107, Liang Tsun Rd., Fong Yuan City, Taichung Hsien, Taiwan

[21] Appl. No.: 899,570

[22] Filed: Jul. 24, 1997

Related U.S. Application Data

[63] Continuation of Ser. No. 633,235, Apr. 16, 1996.

[51] Int. Cl.[6] ..... B25B 13/46

[52] U.S. Cl. ..... 81/61; 81/60

[58] Field of Search ..... 81/60, 61

[56] References Cited

U.S. PATENT DOCUMENTS

| | | | |
|---|---|---|---|
| 827,846 | 8/1906 | Bowser et al. | 81/61 |
| 1,258,381 | 3/1918 | Webb | 81/61 |
| 1,307,485 | 6/1919 | Cunha | 81/61 |
| 2,112,693 | 3/1938 | Douglass | 81/61 X |
| 4,441,387 | 4/1984 | Hendricks | 81/61 |

*Primary Examiner*—James G. Smith
*Attorney, Agent, or Firm*—Varndell Legal Group

[57] ABSTRACT

A ratchet wrench having an annular wheel mounted within one box end thereof, the annular wheel having a plurality of longitudinal teeth equiangularly spaced around the inside for grasping and turning nuts, bolts, etc., and two symmetrical pairs of grooves longitudinally disposed on the outside at two oppoiste locations, two pairs of stop plates respectively mounted in the grooves within the box end, and four springs respectively connected between the stop plates and the grooves to forced into engagement with the teeth of the box end when the wrench is turned in one direction, causing the annular wheel to be turned with the box end; the stop plates are forced backwards into the V-grooves when the wrench is turned in the reversed direction, causing the wrench to run idle.

2 Claims, 3 Drawing Sheets

REVERSIBLE RATCHET WRENCH

This application is a continuation application of Ser. No. 08/633,235, filed Apr. 16, 1996.

BACKGROUND AND SUMMARY OF THE INVENTION

The present invention relates to wrenches, and more particularly to a ratchet wrench which comprises an annular wheel mounted in one box end thereof and having teeth on the inside for grasping and turning nuts, bolts, etc., and a ratchet mechanism mounted between the annular wheel and the box end to force the annular wheel into engagement with the box end when the wrench is rotated clockwise, or to disengage the annular wheel from the box end when the wrench is rotated counter-clockwise.

Regular combination wrenches are commonly comprised of an elongated handle having two opposite ends respectively terminating in an open end and a box end. The box end has axial teeth equiangularly spaced around the inside for positively grasping and turning nuts, bolts, etc. Because the box end cannot be ratcheted, it must be released from the nuts, bolt, etc. after one turn, then attached to the nut, bolt, etc. again, and then turned forwards for another stroke. Therefore, it is not efficient to use such a wrench to turn nuts, bolts, etc.

The present invention has been accomplished to proivde a box end wrench which eliminates the aforesaid drawbacks. According to one aspect of the present invention, the box end wrench comprises an annular wheel mounted within the box end, the annular wheel having a plurality of longitudinal teeth equiangularly spaced around the inside for grasping and turning nuts, bolts, etc., and two symmetrical pairs of grooves longitudinally disposed on the outside at two opposite locations, two pairs of stop plates respectively mounted in the grooves within the box end, and four springs respectively connected between the stop plates and the grooves to force the stop plates outwards, wherein two of the stop plates are forced into engagement with the teeth of the box end when the wrench is turned in one direction, causing the annular wheel to be turned with the box end; the stop plates are forced backwards into the grooves when the wrench is turned in the reversed direction, causing the wrench to run idle. According to another aspect of the present invention, the stop plates include a first diagonal pair and a second diagonal pair alternatively forced into engagement with the teeth of the box end.

DETAILED DESCRIPTION OF THE PREFERRED EMBODIMENT

Figure 1:
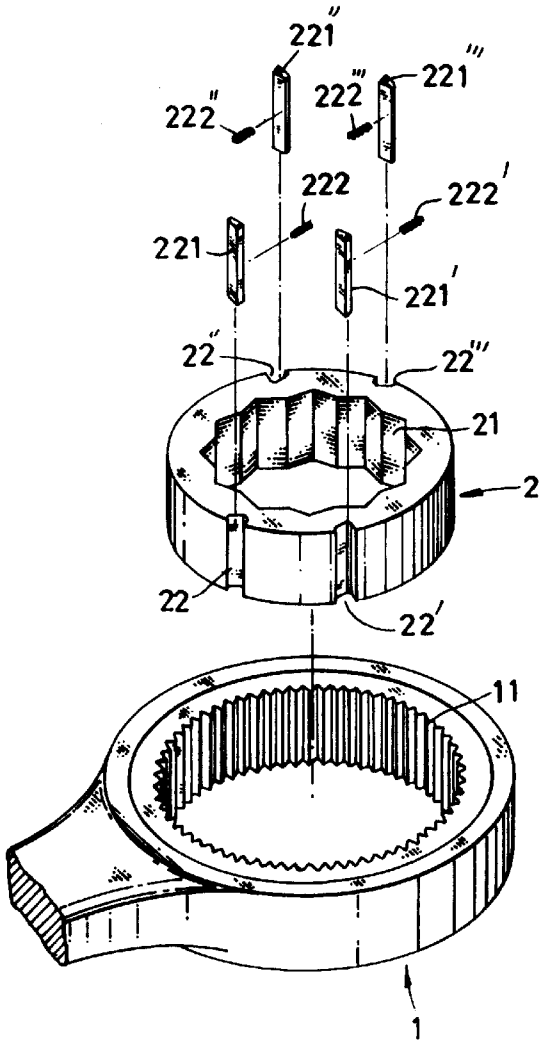
FIG. 1 is an exploded view of the present invention.
Figure 2:
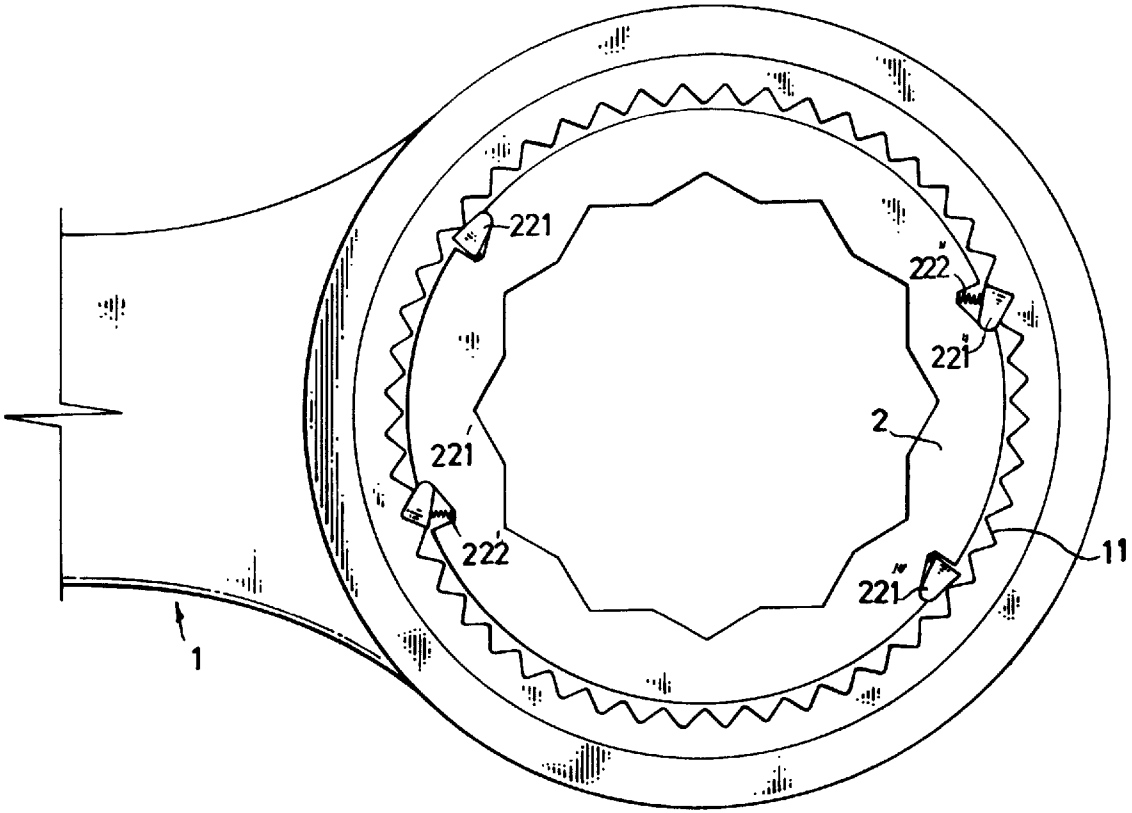
FIG. 2 is a sectional assembly view in an enlarged scale of FIG. 1.
Figure 3:
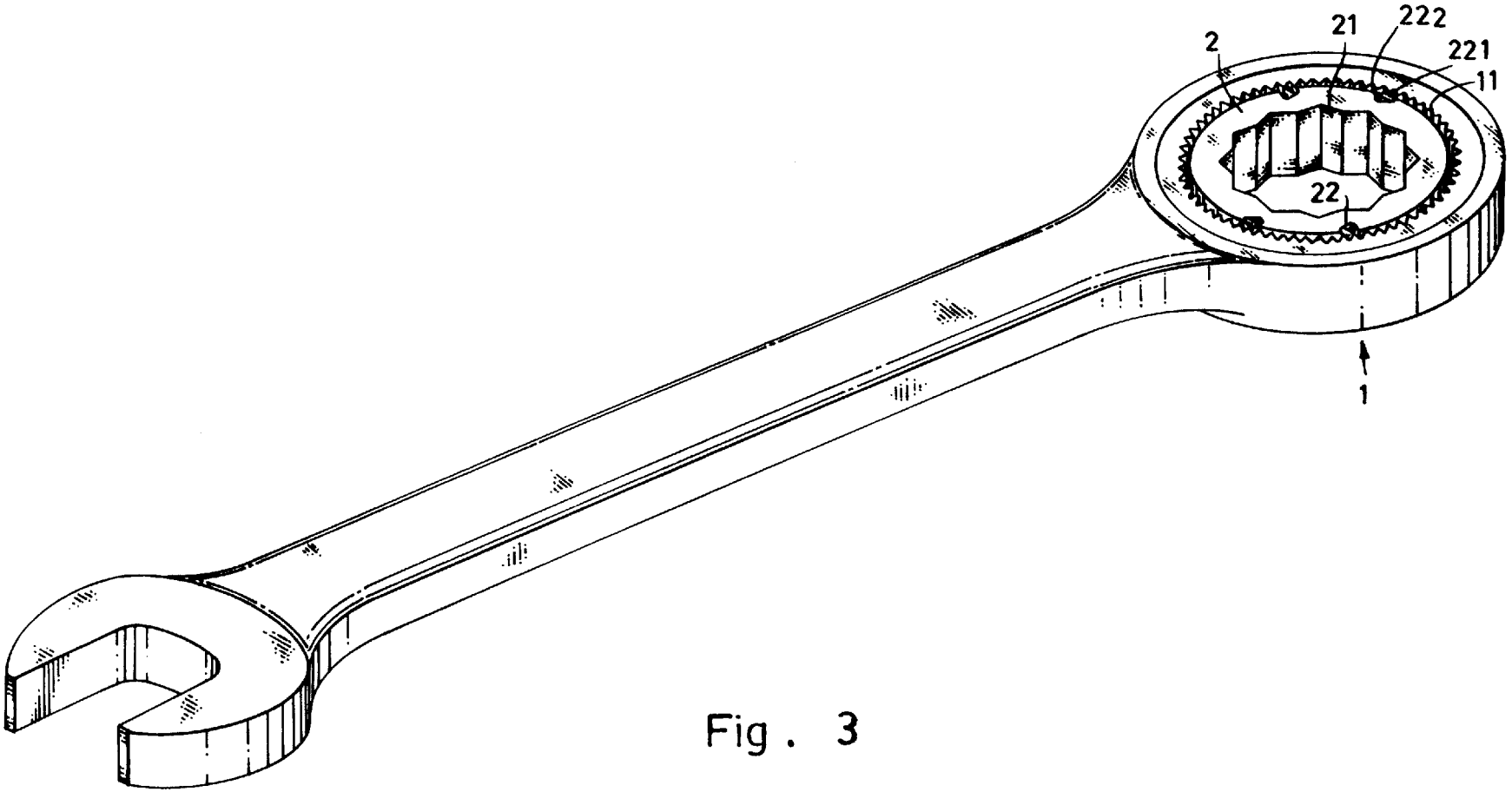
FIG. 3 is an elevational view of a reversible ratchet wrench according to the present invention.

Referring to FIGS. 1, 2, and 3, the box end 1 of a wrench in accordance with the present invention has axial teeth 11 equiangularly spaced around the inside wall. An annular wheel 2 is mounted within the box end 1. The annular wheel 2 has a plurality of longitudinal teeth 21 equiangularly spaced around the inside wall, and two symmetrical pairs of grooves 22, 22'; 22", 22"' longitudinally disposed at the outside wall at two opposite sides. The two grooves of each pair of grooves 22, 22'; 22", 22"' are spaced from each other at 30 degrees. The grooves 22 having three flat sides and a fourth arcuate side. Four stop plates 221, 221', 221", 221"' are respectively mounted in the grooves 22, 22', 22", 22"' within the box end 1 and supported on respective springs 222, 222', 222", 222"'. The stop plates 221, 221', 221", 221"' have a cross section fitting that of the grooves 22, 22', 22", 22"'. Each of the springs 222, 222', 222", 222"' has one end fixedly connected to one groove 22, 22', 22", or 22"' and an opposite end connected to the respective stop plate 221, 221', 221", or 221"'. When the annular wheel 2, the stop plates 221 , 221', 221", 221"', and the springs 222, 222', 222", 222"' are installed, the stop plates 221, 221', 221", 221"' are respectively forced outwards by the springs 222, 222', 222", 222"', causing one diagonal pair of stop plates 221', 221" to engage the tooth flanks of the teeth 11 and the other diagonal pair of stop plates 221, 221"' to engage the tooth crests of the teeth 11. Therefore, the stop plates 221, 221"' act as points of resistance. When the annular wheel 2 is rotated relative to the teeth 11 of the box end 1 at a distance equal to ½ of the tooth pitch, the stop plates 221', 221" are forced into engagement with the tooth crests of the teeth 1, and the stop plates 221, 221"' are forced into engagement with the tooth flanks of the teeth 1, and therefore the points of resistance are shifted from the stop plates 221, 221"' to the stop plates 221', 221". Thus an one-way ratchet mechanism is achieved.

Referring to FIG. 2 again, when the wrench is rotated clockwise, the stop plates 221', 221" are jammed in the teeth 11 of the box end 1, therefore the annular wheel 2 is turned with the wrench. When the wrench is rotated counter-clockwise, the stop plates 221, 221'; 221, 221"' are forced by the teeth 11 of the box end 1 to retreat, causing the box end 1 to run idle. When the turning direction of the wrench is changed from the counter-clockwise direction to the clockwise direction again, the stop plates 221, 221"' are jammed in the teeth 11 of the box end 1, and the annular wheel 2 is turned with the wrench. Therefore, the wrench runs idle when turned counter-clockwise, or turns annular wheel 2 in the same direction when turned clockwise. Because the two diagonal pairs of stop plates 221, 221"'; 221' 221" are alternatively forced into engagement with the teeth 11 to act as points of resistance, they do not continuously bear the force. Therefore, the service life of the stop plates 221, 221', 221", 221"' is prolonged. Furthermore, when the wrench is turned backwards and then turned forwards, the positioning error is confined to as narrow as ½ of the tooth pitch of the teeth 11.

I claim:

1. A wrench comprising a box end, said box end having a circular opening and an annular wheel arranged in said circular opening, an inner wall of said circular opening having a plurality of axial teeth equiangularly spaced around an inside wall thereof, said axial teeth having two flat sides, said annular wheel having an inner wall and an outer wall, said inner wall of said annular wheel having a plurality of equiangularly spaced longitudinal teeth for grasping and turning nuts and bolts, said outer wall of said annular wheel having two symmetrical pairs of grooves extending across a depth of said annular wheel at opposing sides thereof, said grooves having first, second and third flat sides and a fourth arcuate side, two pairs of stop plates respectively mounted in said grooves and extending across said annular wheel; said stop plates having a curved top, first and second flat sides and a flat bottom, said curved top abutting and closely fitting within said fourth arcuate side of a respective said groove, and said bottom and said first side of said stop plate adapted to engage said two flat sides of a respective said axial teeth; and four springs respectively arranged between said second side of said stop plates and said grooves for forcing said stop plates outwards into an engaging position, wherein one of said two pairs of said stop plates are forced into engagement with said teeth of said box end when said wrench is turned in one direction, causing said annular wheel to be turned with said box end; said stop plates are forced backwards into said grooves when said wrench is turned in the reversed direction, causing said wrench to run idle for a complete 360 degree turn; and said stop plates include a first diagonal pair and a second diagonal pair alternatively forced into engagement with said teeth of said box end.

2. The wrench of claim 1, wherein said grooves at each side of said annular wheel are spaced from each other by an angle of 30 degrees relative to a center of said box-end.

* * * * *